United States Patent [19]

Lewis et al.

[11] Patent Number: 4,671,046

[45] Date of Patent: Jun. 9, 1987

[54] CONTAINER COVER FORMING APPARATUS AND METHOD

[75] Inventors: D. Michael Lewis; David L. Wolf; Ray L. Russell, all of Cedar Falls, Iowa

[73] Assignee: Container Corporation of America, Chicago, Ill.

[21] Appl. No.: 881,941

[22] Filed: Jul. 3, 1986

[51] Int. Cl.[4] ..... B65B 7/28; B65B 51/02

[52] U.S. Cl. ..... 53/488; 53/306; 53/329; 53/387

[58] Field of Search ..... 53/329, 374, 376, 377, 53/306, 312, 387, 485, 487, 488, 309

[56] References Cited

U.S. PATENT DOCUMENTS

| | | | |
|---|---|---|---|
| 2,850,858 | 9/1958 | Daly et al. | 53/306 |
| 3,137,112 | 6/1964 | Kulleseid | 53/376 |
| 3,634,995 | 1/1972 | Curtis | 53/387 X |
| 3,810,345 | 5/1974 | Lemmond et al. | 53/306 |
| 3,913,300 | 10/1975 | Benzing | 53/306 X |
| 3,935,693 | 2/1976 | Lehle | 53/387 X |
| 3,979,883 | 9/1976 | Patsaros | 53/306 |
| 4,375,144 | 3/1983 | Möller | 53/309 |
| 4,459,791 | 7/1984 | Booth | 53/312 X |

*Primary Examiner*—Horace M. Culver

*Attorney, Agent, or Firm*—Richard W. Carpenter

[57] ABSTRACT

An apparatus and method for squaring up the sides of a bulk shipping container and for forming a paperboard cover over and securing it to the upper end of the container.

12 Claims, 9 Drawing Figures

FIG 7
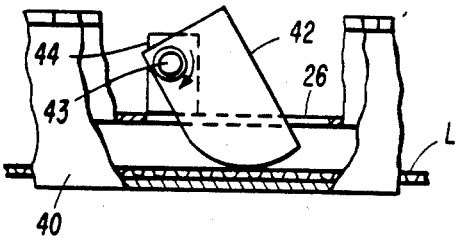
FIG 4
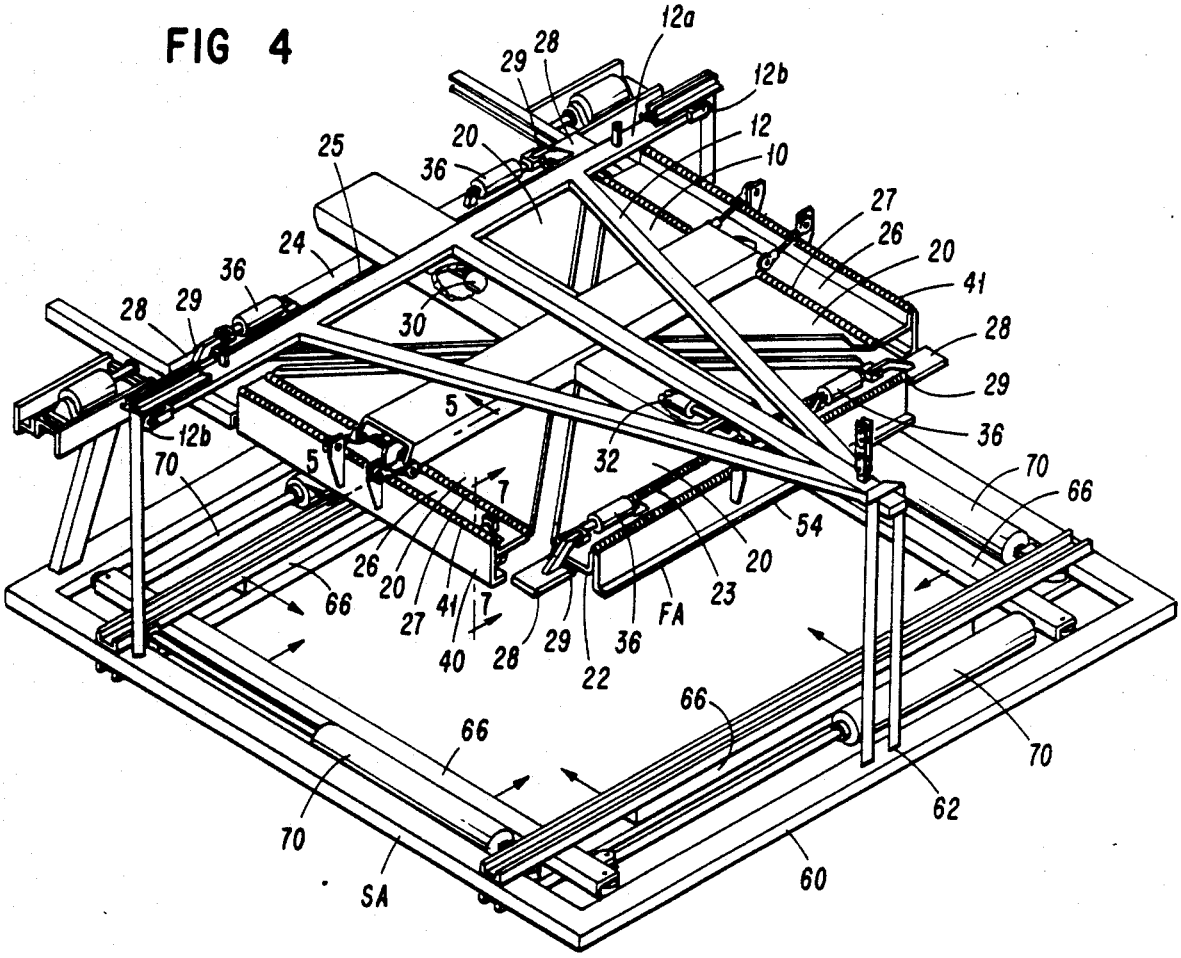
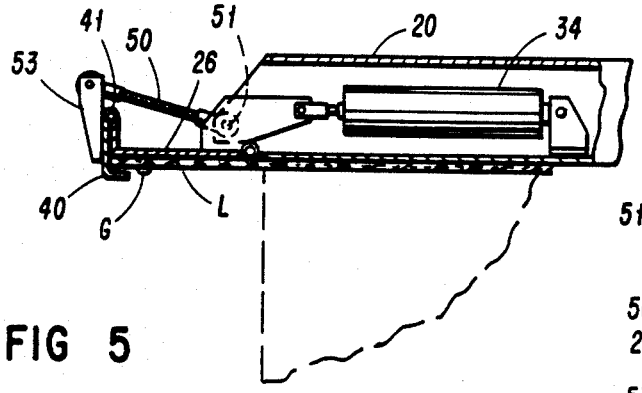
FIG 5
FIG 6
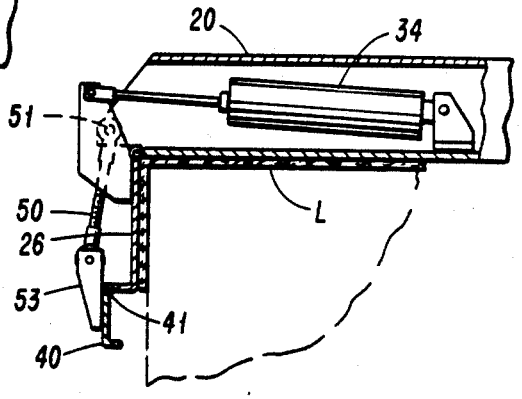

CONTAINER COVER FORMING APPARATUS AND METHOD

BACKGROUND OF THE INVENTION

1. Field of the Invention

This invention relates generally to cover forming devices, and more particularly to a device for squaring the upper end of a filled bulk shipping container and then forming a cover on the upper end of the container and then securing it thereto.

2. Description of the Prior Art

A prior art search conducted in the United States Patent and Trademark Office and directed to the subject matter of this application disclosed the following U.S. Pat. Nos.: 1,548,231; 1,859,640; 2,066,449; 2,678,591; 3,029,570; 3,327,452; 3,634,995; 3,685,253; 3,863,423; 3,896,607; 3,913,300; 3,975,994, 3,979,883; 4,400,929.

None of the prior art patents uncovered in the search discloses an apparatus or method which includes means for squaring up the bulging sides of a filled bulk shipping container and then forming a cover over the upper end of the container and securing it to the container.

SUMMARY OF THE INVENTION

It is an object of this invention to provide an apparatus and method for squaring up the bulging sides of a filled bulk paperboard shipping container and then forming a cover over the end of the container and securing it thereto.

A more specific object of the invention is the provision, in a device of the type described, of a cover forming mechanism which includes a plurality of fluid cylinder actuated, flap folding wings for supporting a container cover blank, for folding the blank to form a cover, and for securing it to a container.

Another object of the invention is the provision, in a device of the type described, of a mechanism for squaring the uneven sides of a filled bulk shipping container prior to the formation of the cover on the upper end of the container.

These and other objects of the invention will be apparent from an examination of the following description and drawings.

BRIEF DESCRIPTION OF THE DRAWINGS

FIG. 4 is a fragmentary perspective view of the flap folding and container squaring assemblies shown in the previous views;

FIG. 5 is a fragmentary vertical sectional view taken on line 5—5 of FIG. 4;

FIG. 6 is a view similar to FIG. 5, but with the wing shown in the flap folding or vertical position;

FIG. 7 is a fragmentary side elevational view of a portion of the cover blank retaining mechanism;

It will be understood that, for purposes of clarity, certain elements may have been intentionally omitted from certain views where they are believed to be illustrated to better advantage in other views.

DESCRIPTION OF THE PREFERRED EMBODIMENT

Figure 8:
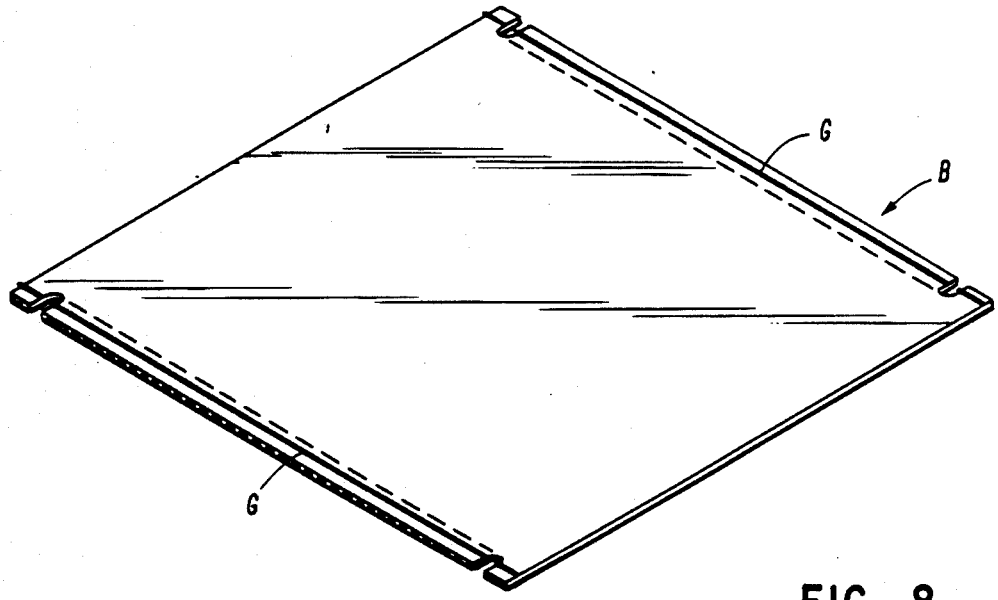
FIG. 8 is a perspective view of a paperboard blank from which a cover is formed.
Figure 9:
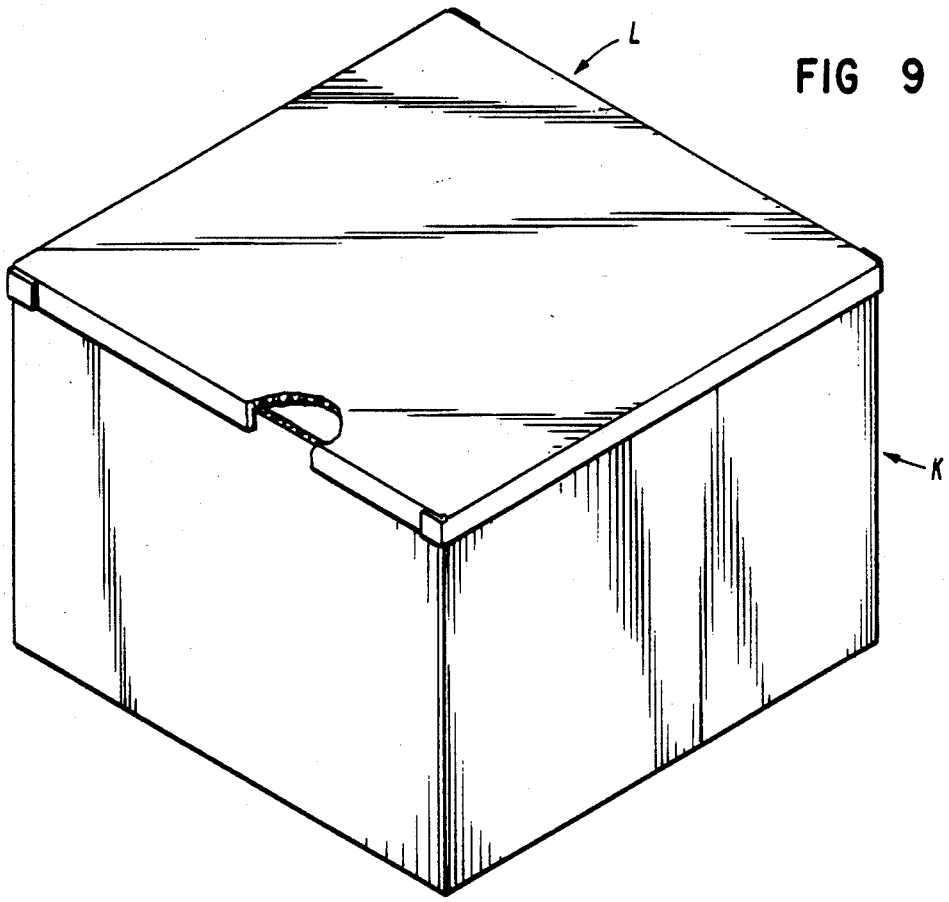
FIG. 9 is a perspective view of a container with a formed cover positioned thereon.

Referring now to the drawings for a better understanding of the invention, it will be seen that the cover or lid indicated generally at L in FIG. 9, may be formed from the unitary blank B of foldable sheet material, such as paperboard, illustrated in FIG. 8. The cover is formed on and attached to the container K, as seen in FIG. 9, by the machine illustrated in the other views and which is the subject matter of this application.

Figure 1:
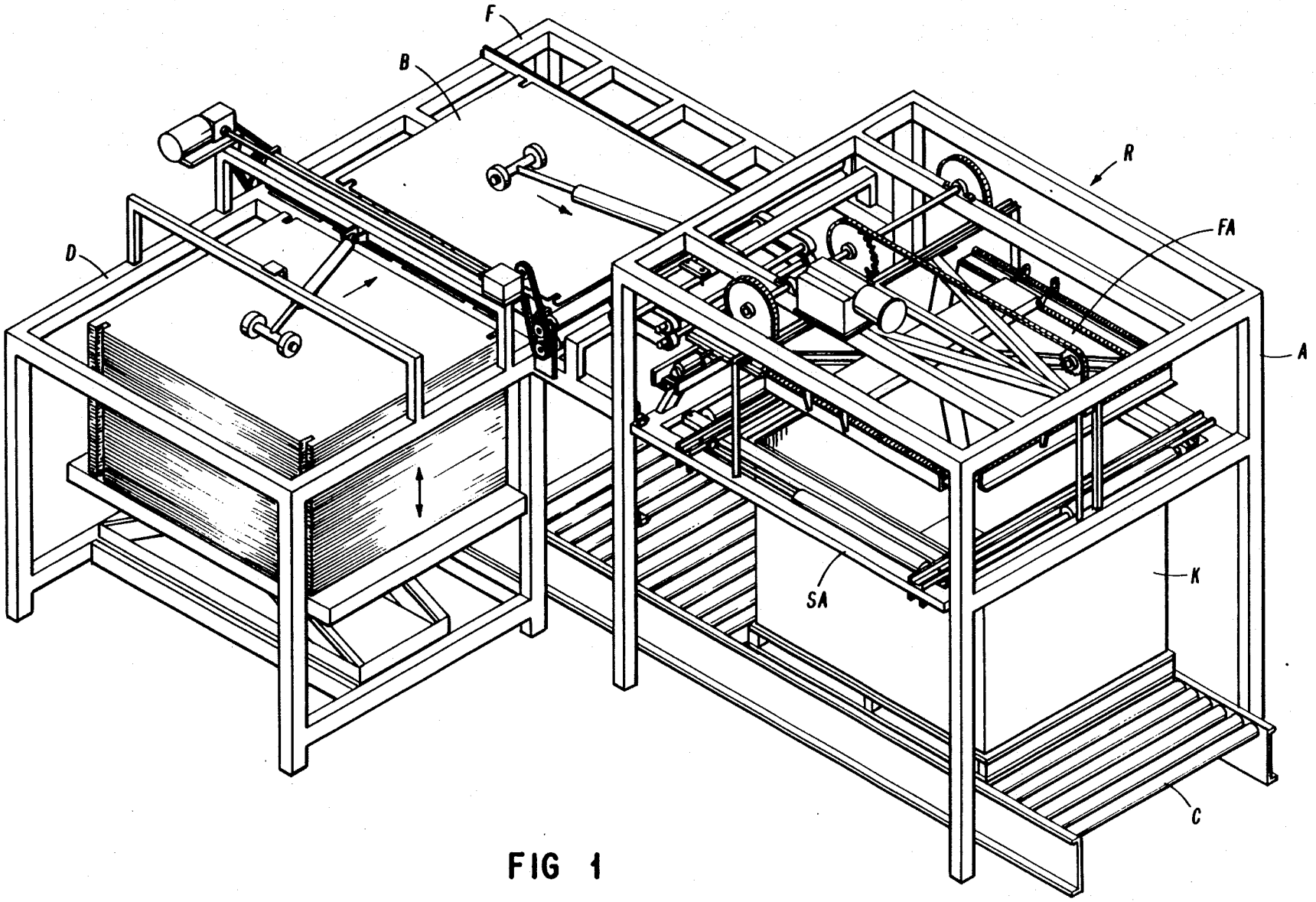
FIG. 1 is a fragmentary perspective view of a container cover forming apparatus embodying features of the invention, as shown attached to apparatus for delivering blanks to the forming mechanism.

As best seen in FIG. 1, the apparatus A, which forms the essential part of this invention, is shown positioned adjacent a blank feeding device F and a destacking device D. The destacker transfers blanks from a pile to the feeder from where they pass into the apparatus. The destacking device is the subject of a separate patent application which is currently pending in the United States Patent and Trademark Office.

Figure 2:
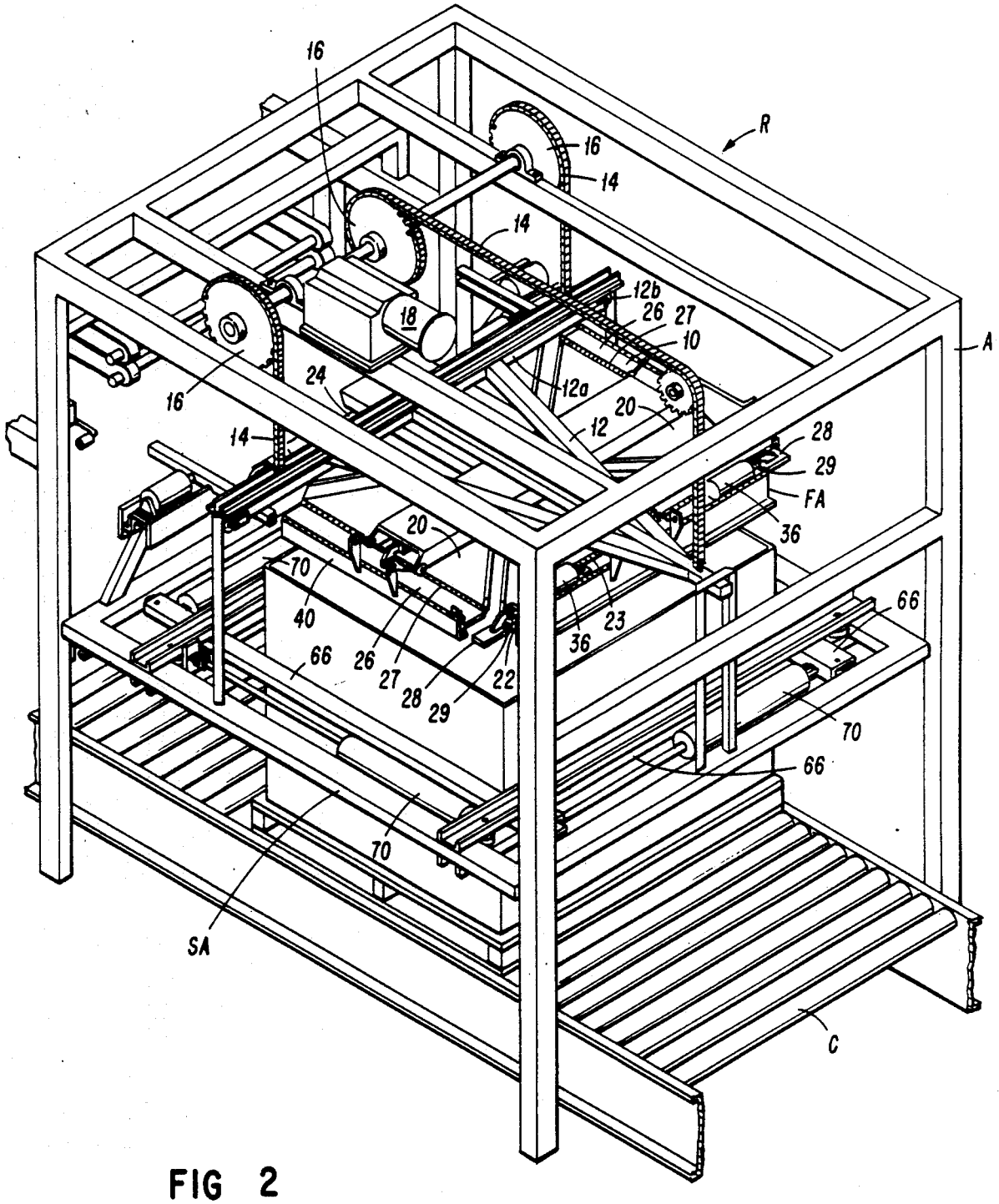
FIG. 2 and 3 are enlarged, fragmentary perspective views of a portion of the structure illustrated in FIG. 1, but showing the mechanism in different positions.
Figure 3:
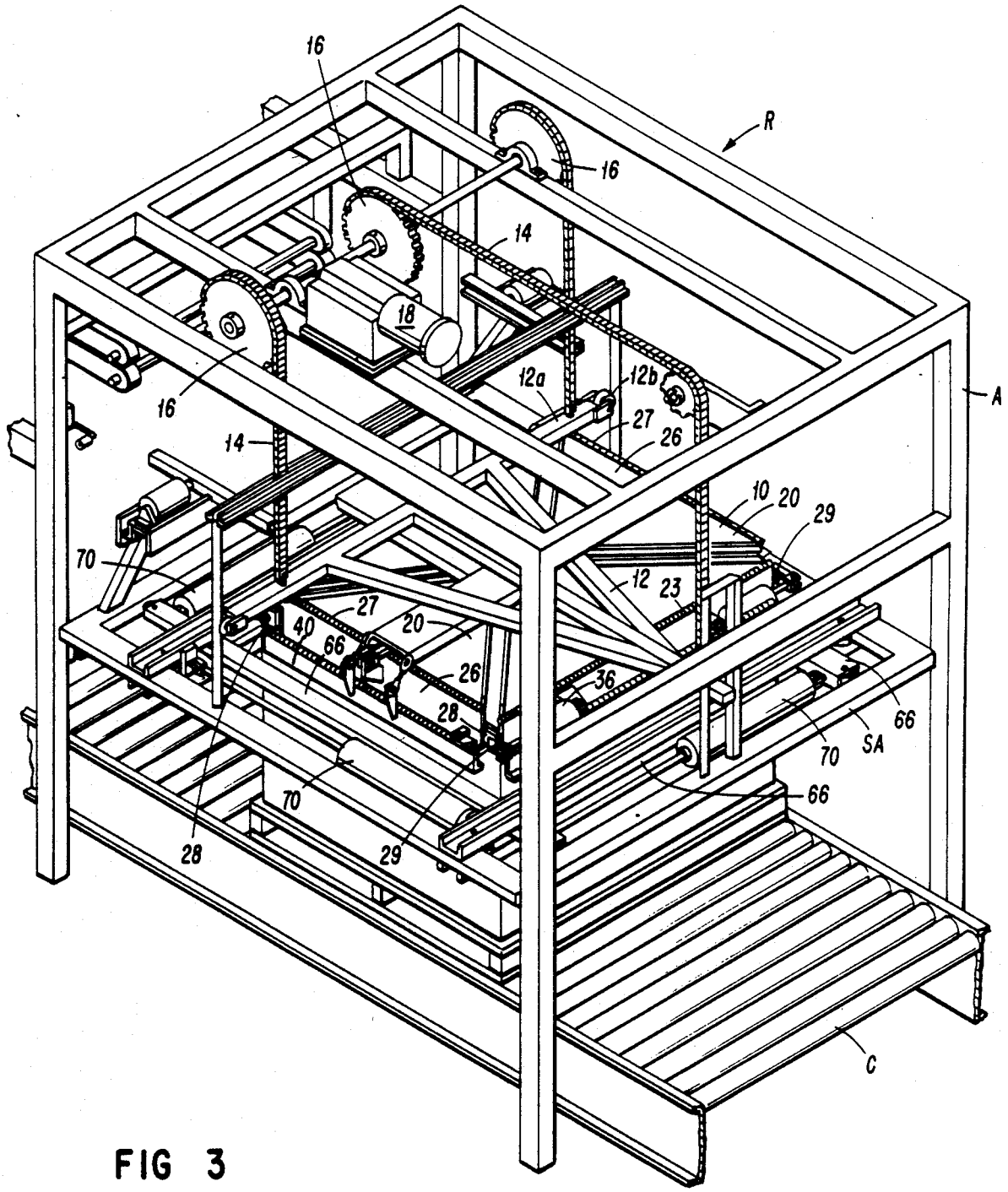

As best seen in FIGS. 1–3, apparatus A includes a frame indicated generally at R from which is supported a box-squaring assembly SA, and a cover-forming assembly FA. The cover-forming and box-forming assemblies are best seen in FIGS. 4–7.

The cover forming assembly FA comprises a carriage or platen 10 with a generally triangular upper section 12 which includes a a transversely extending rear bar **12*a*, having a pair of guide rollers 12*b* mounted at opposite ends thereof. The purpose of these rollers is described later in the specification. The carriage or platen 10 is supported from frame R, by three sprocket driven chains 14, the upper ends of which are permanently fixed to sprockets 16, rotatably mounted on frame R and driven by motor 18, which is also suported on frame R. The carriage or platen 10 also includes a generally rectangular lower section 20**.

As best seen in FIG. 4, the cover-forming assembly FA also includes a front flap folder or wing 22, a rear wing 24, a pair of side wings 26, and four corner wings 28, which are pivotally mounted on pivots 23, 25, 27, and 29, respectively, to platen lower section 20.

The flap folders or wings are moved into and out of engagement with cover blank marginal areas or flaps by means of front, rear, side and corner fluid actuated cylinders 30, 32, 34, and 36, respectively, which are also mounted on platen lower section 20.

Referring now to FIGS. 4–7, it will be seen that each of the side flap folders or wings 26 are elongated and generally I-shaped in cross-section, with the longer inboard section pivoted to the platen at 27, and the shorter outboard section having hinged thereto on pivot 41 a generally L-shaped cover support bracket 40. Each support bracket 40 also includes a longer inboard section and a shorter outboard section, with the outboard section being hinged on pivot 41 to the outboard end of related wing 26.

In order to keep the cover blank from slipping backwards out of each side wing support bracket 40 there may be provided a small ratchet-type retaining plate 42 which is pivotally mounted on pin 43 to a lug 44 which in turn is attached to wing 26, as best seen in FIG. 7.

Support bracket 40 is also connected to platen lower section 20 by a separate linkage which caused the bracket to move out of the way after the cover blank has been placed on the container and the folding wings have moved from the cover holding position of FIG. 5 to the flap folding position of FIG. 6.

This linkage includes a link 50 which is pivoted at its inboard end, on pivot 51, to a lug on platen lower section 20 and at its outboard end, on pivot 53, to a lug on the inboard section of support bracket 40.

Front wing 22 may also be provided with an L-shaped bracket 54 and a comparable linkage arrangement which functions in the same manner to move the bracket out of the way as wing 22 moves down. However, in the case of front wing bracket 54, the shorter outboard section extends outwardly, because it is only used as a stop to limit the forward movement of the cover blank and does not serve to support the black.

Now, referring to FIG. 4, it will be seen that the squaring assembly SA includes a frame or squaring base 60 having a U-shaped support bracket 62 rigidly attached thereto and adapted to be received over extremities of the carriage upper section 10 and transverse bar 12*a* to provide a lost motion connection between the cover-forming assembly and the box-squaring assembly, the purpose of which is described later in the specification.

The squaring assembly also includes a pair of vertically extending guide shafts which are adapted to be engaged by the guide rollers 12*b* on the ends of bar 12*a*.

This arrangement keeps the squaring assembly in proper alignment with the cover forming assembly as they move both with and relative to each other.

The squaring of the filled container is accomplished by opposed pairs of movable side bars 66 which are moved by fluid actuated cylinders 70 mounted on base 60. As the bars of each pair are moved toward each other, the container, which may be bulging and out of square after it has been filled, will be brought into square, so that when the cover is formed thereon, the cover and box will fit together snugly.

Now to describe the operation of the apparatus and method of squaring up the container, forming of the cover on the container, and attaching it to the upper end of the container.

Referring to FIG. 1, it will be seen that the bulk shipping container K is moved along conveyor C until it is directly under the apparatus A.

Then the carriage or platen 10 is lowered, by means of the motor, sprockets, and chains, from the frame R until the squaring assembly SA, which is suspended from the forming assembly FA, is enclosing the upper end of the container.

At this point the fluid cylinders 70 are actuated and urge the movable side bars 66 of each pair toward each other to square up the upper end of the container.

After this has been accomplished, a blank B of foldable sheet material is moved from the feeding device F into the platen of the cover forming assembly until the leading edge of the cover blank is against the rear surface of the front wing bracket and the sides of the blank are supported on side wing support brackets 40. As the blank moves from feeder F to cover-forming apparatus A, a strip of hot melt adhesive G is applied to the underside of each side marginal area of the blank. The adhesive strip is located inwardly a slight distance from the edge of the blank, so that, as the edge rides over the support brackets 40 of side flap folding wings 26, the adhesive will not touch the bracket. After the blank is in position under the platen 10, the forming apparatus is lowered, from the position shown in FIG. 2 to the position shown in FIG. 3, until the blank B rests on the top of the container.

At this time the side wings are folded downwardly 90 degrees causing the marginal areas or side flaps of the cover blank to be forced against the opposite side walls of the container and be adhesively secured thereto.

Next, the front and rear wings are moved downwardly 90 degrees to fold the front and rear marginal areas or flaps of the cover down against the outer surfaces of the front and rear side walls of the container.

Then the corner flap folders or wings are moved toward each other to fold the corner flaps inwardly 90 degrees from the planes of the front and rear flaps, so that they overlap and are adhesively secured to the end portions of the side flaps, as best illustrated in FIG. 9.

After this process has been completed, the carriage or platen is moved upwardly, bringing with it the cover forming apparatus and the container squaring apparatus, so that the container with the cover formed and attached to the upper end thereof can be moved along the conveyor out from under the apparatus to make way for another container to repeat the process.

Thus, it will be appreciated that the invention provides a unique apparatus and method for squaring up a bulging, filled bulk shipping container, and then placing a cover blank on the container, forming a cover from the blank, and finally securing the cover to the container.

What is claimed is:

1. A device for forming a unitary paperboard cover over the upper end of a bulk shipping container and securing it thereto, said device comprising, in combination:

(a) a frame;

(b) a cover forming assembly suspended from said frame and adapted for vertical movement relative thereto;

(c) means for effecting the vertical movement of said cover forming assembly;

(d) said cover forming assembly including:

(i) a plurality of pivotally movable flap folding wings engageable with side, end, and corner flaps of a container cover;

(ii) means for effecting the pivotal movement of said wings;

(e) a container squaring assembly suspended from said cover forming assembly by a lost motion connection;

(f) said container squaring assembly including:

(i) pairs of opposed squaring bars disposed at right angles to each other with the bars of each pair adapted for lateral movement toward and away from each other;

(ii) means for effecting the lateral movement of said squaring bars.

2. A device according to claim 1, wherein said cover forming assembly is suspended from an upper portion of said frame by chains engaged with motor driven sprockets mounted on said frame and operable to raise and lower said cover forming assembly.

3. A device according to claim 1, wherein said means for effecting the movement of said cover forming assembly includes chains engageable with sprockets and a motor mounted on said frame.

4. A device according to claim 1, wherein said lost motion connection between said container squaring assembly and said cover forming assembly includes at least one inverted, generally U-shaped bracket fixed to the former and removably engageable with the latter.

5. A device according to claim 1, wherein said means for effecting the pivotal movement of said flap folding wings comprises fluid actuated cylinders.

6. A device according to claim 1, wherein certain of said cover flap folding wings include means for temporarily supporting a flat cover blank prior to its being formed.

7. A device for forming a unitary paperboard cover over the upper end of a bulk shipping container and securing it thereto, said device comprising, in combination:

(a) a frame;
(b) a cover forming assembly supported by said frame;
(c) said cover forming assembly including:
  (i) a plurality of pivotally movable flap folding wings engageable with side, end, and corner flaps of a container cover;
  (ii) means for effecting the pivotal movement of said wings;
(d) certain of said flap folding wings including movable means for temporarily supporting a flat cover blank prior to its being formed.

8. A device according to claim 7, wherein said cover blank supporting means includes a generally L-shaped bracket pivotally connected to an outboard end of a related flap folding wing and adapted to be moved out of the way of said cover blank as said related wing is moved to flap folding position.

9. A device according to claim 8, wherein said cover supporting means includes a pivotally mounted, ratchet type latch for holding said cover blank in said holding bracket until time for it to be released.

10. A device according to claim 8, wherein said cover supporting bracket is also connected to said frame by a linkage that is not parallel to its related flap folding wing.

11. A device for forming a unitary paperboard cover over the upper end of a filled bulk shipping container and securing it thereto, said device comprising, in combination:

(a) a frame;
(b) a carriage suspended from said frame and adapted for vertical movement relative thereto;
(c) means for effecting the vertical movement of said carriage;
(d) a cover forming assembly joined to the underside of said carriage and movable therewith;
(e) said cover forming assembly including:
  (i) a plurality of pivotally movable flap folding wings engageable with side, end, and corner flaps of a container cover;
  (ii) means for effecting the pivotal movement of said wings;
(f) a container squaring assembly suspended from said cover forming assembly by lost motion connections;
(g) said container squaring assembly including:
  (i) pairs of opposed squaring bars disposed at right angles to each other with the bars of each pair adapted for lateral movement toward and away from each other;
  (ii) means for effecting the lateral movement of said squaring bars.

12. A method for forming a unitary paperboard cover over and securing it to our upper end of a filled bulk shipping container, comprising the steps of:

(a) lowering a squaring assembly over the upper end if a bulk shipping container and bringing squaring bars of opposed pairs toward each other to square up the upper end of the container;
(b) applying strips of adhesive to the underside of opposed side marginal areas of a cover forming blank of paperboard;
(c) inserting said blank under a cover forming assembly;
(d) lowering said cover forming assembly until said cover blank is resting on said container;
(e) sequentially folding marginal areas of said cover blank downwardly and laterally to secure them to each other and to said container to form a cover on said container.

* * * * *